United States Patent [19]

Hellyer

[11] Patent Number: 4,472,170

[45] Date of Patent: Sep. 18, 1984

[54] COAL-WATER SLURRY COMPOSITIONS

[75] Inventor: James A. Hellyer, Milford, Ohio

[73] Assignee: The Procter & Gamble Company, Cincinnati, Ohio

[21] Appl. No.: 453,639

[22] Filed: Dec. 27, 1982

[51] Int. Cl.[3] ..... C10L 1/32

[52] U.S. Cl. ..... 44/51; 44/77; 536/18.3; 536/18.6

[58] Field of Search ..... 44/51, 77; 536/18.3, 536/18.6

[56] References Cited

U.S. PATENT DOCUMENTS 3,321,461 5/1967 Onodera ..... 536/18.6
3,772,269 11/1973 Lew ..... 536/18.6
4,358,293 11/1982 Mark ..... 44/77
4,398,919 8/1983 Zakaria ..... 44/51

FOREIGN PATENT DOCUMENTS 1247743 8/1967 Fed. Rep. of Germany ..... 44/77

*Primary Examiner*—William R. Dixon, Jr.
*Assistant Examiner*—Margaret B. Medley
*Attorney, Agent, or Firm*—Richard C. Witte; Ronald L. Hemingway

[57] ABSTRACT

Aqueous coal slurries comprising comminuted coal, water and O-glycoside surfactant. The O-glycoside serves the dual functions of dispersant and suspending agent for the coal.

11 Claims, No Drawings

COAL-WATER SLURRY COMPOSITIONS

TECHNICAL FIELD

The present invention relates to aqueous slurries of coal powder. More particularly, the invention relates to the use of surfactants which allow the production of pumpable, stable, high solid content suspensions of finely-ground coal in water. These suspensions can then be transported by pipeline or be handled by a country's existing fuel oil infrastructure (barges, tank cars, tank trucks, storage tanks, pipelines) and be burned in coal-, oil-, or gas-designed boilers, furnaces, etc.

SUMMARY OF THE INVENTION

The invention is directed to the use of O-glycoside surfactants as dispersing and suspending agents for aqueous coal slurries.

BACKGROUND

Due to the limited availability and rising cost of petroleum, it is becoming increasingly desirable to develop nonpetroleum energy sources and to maintain a stable supply thereof. The more effective utilization of coal, which would greatly reduce the dependence of the world economy on petroleum, is now being enthusiastically reconsidered. However, since coal is a solid, its use presents transportation and handling difficulties not encountered with petroleum.

In order to facilitate handling and use of coal, coal-water slurries (≡CWS"), consisting of fine particles of coal dispersed in water, have been developed. The amount of water necessary to form a pumpable slurry varies with the surface characteristics and extent of comminution of the coal. A coal slurry made up of particles, most of which will pass through a 200 mesh Tyler sieve can only contain from about 40 to 45 weight percent coal. When the coal content of a slurry (without additives) is increased much beyond this level, the viscosity of the slurry rises markedly and the slurry becomes unpumpable. To disperse the coal particles in water, achieve a high solids content slurry, and maintain an acceptable slurry viscosity, it is necessary to use a surfactant to reduce the coal/water surface tension and thereby facilitate the wetting of particle surfaces. See, for example, U.S. Pats. Nos. 4,302,212, Yamamura et al., issued Nov. 24, 1981; 4,304,572, Wiese et al., issued Dec. 8, 1981; and 4,104,035, Cole et al., issued Aug. 1, 1978; and 4,282,006, Funk, issued Aug. 4, 1981. All of the surfactants cited in the previous patents are of the anionic type, which the prior art generally recognizes as the preferred type of surfactant for use in dispersing solid particles.

Although the surfactants which have heretofore been used in coal slurries are effective in dispersing the coal particles and reducing the initial viscosity of the slurry, they are relatively ineffective in keeping the particles suspended in the slurry, i.e., the particles tend to settle out of the slurry due to gravitational forces if the slurry is not kept in motion. Often, this settling results in "hard packing" of the coal beneath a separated layer of water, a very undesirable occurrence. To avoid or delay settling, it has been generally found necessary to include a suspending agent (e.g., clays, starches or gums) in addition to the surfactant in the composition.

The object of the present invention is to provide superior surfactants for use in coal slurries, and, in particular, to provide surfactants which perform both dispersing and suspending functions in the slurries. A further objective is to provide surfactants which do not add nitrogen, sulfur or ash-producing elements (sodium or other metals) to the coal slurry.

DESCRIPTION OF THE PREFERRED EMBODIMENTS

In accordance with the present invention, it has been found that O-glycoside surfactants are superior surfactants for use in coal slurries. O-glycosides are compounds composed of the residue of an aliphatic or aromatic alcohol (called the aglycone) bonded through oxygen to the hemiacetal or hemiketal carbon of a saccharide residue which in turn may be bonded through oxygen linkages to other saccharide residues, O-glycoside surfactants provide excellent dispersion of the coal particles and also contribute to the suspension of said particles. Since O-glycosides belong to the nonionic class of surfactants rather than the anionic class generally used as CWS dispersants, it was unexpected that they should function as highly effective CWS dispersants. Furthermore, it was not anticipated that they should function as suspending agents.

Because of the coal particle suspending power provided by the surfactants of the invention, the need for separate suspending agents is greatly reduced and, in many instances, completely eliminated. Moreover, these nonionic surfactants, which consist entirely of carbon, hydrogen, and oxygen, do not add nitrogen, sulfur, phosphorus or ash-forming elements (e.g., sodium or calcium) to the coal slurry. Accordingly, in the combustion of the CWS, the contribution of the O-glycosides to the amount and the fusion temperature of the ash produced and to air pollution is negligible.

In accordance with the present invention, coal-water slurries having improved physical stability are provided, the said slurries comprising:

a. from about 50 wt. % to about 80 wt. % of finely divided coal particles having a particle size such that substantially none of said particles has a size greater than 4 mesh (all mesh sizes herein are with reference to the Tyler Standard Screen system unless specified otherwise);

b. from about 15 wt.% to about 50 wt.% water; and c. from about 0.01 wt. % to about 5 wt. % of O-glycoside surfactants on an active basis (including all homologs and isomers of the O-glycosides).

The O-glycosides may be added to the slurry as a 10% to 100% active O-glycoside product, the remainder of the product being composed of unreacted aliphatic or aromatic alcohol(s), unreacted saccharide(s), polysaccharides, other reaction byproducts, or other additives.

Preferred comminuted coal concentrations in a CWS are from about 60% to about 75% by weight, based on the total amount of the aqueous slurry. Preferably, at least 40 wt.% of the coal particles should be smaller than 200 mesh. As will be described infra, coals having particle size distributions skewed toward particular ranges within this broad range may be most preferable, depending upon the type of coal or the type of O-glycoside used in the slurry.

All percentages herein are "by weight" unless specified otherwise.

Preferred O-glycoside surfactants of the present invention have the formula $RO(R'O)_t—(Z)_x—H$ wherein $RO(R'O)_t$ is the aglycone, R is an aliphatic or aromatic hydrocarbon group (linear or branched; open-chain or cyclic; saturated or unsaturated; and optionally, substituted with nonionic groups composed of carbon, hydrogen, oxygen, and combinations thereof) of from 6 to about 32 carbon atoms, R' is an alkyl or alkenyl group (linear or branched chain and, optionally, substituted with hydroxyl groups) of from 2 to 4 carbon atoms, t is a single number or distribution of numbers from 0 to about 30, Z is the residue of a reducing monosaccharide, and x is a single number or distribution of numbers from 1 to about 50. Preferably R is alkyl or alkenyl of from 8 to 18 carbon atoms, t is O, Z is the glucosyl moiety and x is from about 1 to about 25.

"Reducing monosaccharides" include the hexoses and pentoses. Typical examples are glucose, mannose, galactose, fructose, rhamnose, ribose, talose, xylose, and the like. For reasons of convenience and availability, a preferred reducing monosaccharide is glucose. Materials which can be hydrolyzed to reducing saccharides can serve as the source of saccharide. These include starches, dextrin, maltose, lactose, sucrose, cellulose, cellobiose, hemicelluloses, glycogens, levoglycosan, methyl glucoside, ethyl glucoside, propyl glucoside, isopropyl glucoside, butyl glucoside, ethoxylated ethylene glycol glucoside, ethoxyethyl glucoside, and glycerol glucoside. For reasons of convenience and availability, a preferred material that can be hydrolyzed to a reducing saccharide is cornstarch.

The O-glycosides are known compounds which can be prepared by a variety of techniques. The general techniques do differ, however, between those for alkyl and arylalkyl O-glycosides and those for aryl and alkaryl O-glycosides.

The alkyl and arylalkyl O-glycosides can be prepared by the acid-catalyzed reaction of an alkanol or arylalkanol (or an alkoxylated aliphatic or aromatic alcohol) with a reducing monosaccharide (or a compound hydrolyzable to a reducing monosaccharide). Examples of suitable alcohols are cyclohexyl, benzyl, octyl, 2-ethylhexyl, isononyl, decyl, dodecyl, tridecyl (mixed isomers), hexadecyl, octadecyl, oleyl, hydroxystearyl, and isostearyl alcohols. If the alcohols are alkoxylated, the alkoxy groups can be ethoxy, propoxy or butoxy groups or mixtures thereof. Examples are the reaction product of dodecanol with five moles of ethylene oxide and the reaction product of p-nonylphenol with five moles of propylene oxide. For purposes of simplicity herein, the terms alkyl and arylalkyl will be understood to include alkenyl and arylalkenyl, unless specified otherwise.

Preparation of O-glycosides (of the alkyl and arylalkyl types) is described in U.S. Pats. Nos. 3,547,828, Mansfield et al., issued Dec. 15, 1970; 3,839,318, Mansfield, issued Oct. 1, 1974; 3,219,656, Boettner, issued Nov. 23, 1965; 3,721,633, Ranauto, issued Mar. 20, 1973; 3,772,269, Lew, issued Nov. 13, 1973; and 3,598,865, Lew, issued Aug. 10, 1971; all incorporated herein by reference.

The aryl and alkaryl O-glycosides traditionally have been prepared by anomeric halogen replacement [e.g., Michael, Am. Chem. J., 1,305 (1879); ibid., 6,336 (1885); Koenigs and Knorr, Ber., 34, 957 (1901); and Borkowski et al., Acta. Polon. Pharm., 34, Nr. 3,251 (1977)]; glycoside ester group replacement [e.g., Helferich and Schmitz-Hillebrecht, Ber., 66, 378 (1933); and Montgomery et al., J. Am. Chem. Soc., 64, 690 (1942)]; and orthoester intermediates [e.g., Bochkov et al., Izv. Akad. Nauk. SSSR, Ser. Khim., 1143 (1960)]. More recently, aromatic O-glycosides have been prepared by the direct replacement of the anomeric hydroxyl group with weakly acidic aryloxy residues in the presence of a protic acid system [e.g., Grynkiewicz, Pol. J. Chem., 53, 1571, (1979)]. Examples of suitable aromatic alcohols for use in preparing aryl and alkaryl O-glycosides are phenol, cresol, tert-butylphenol, octylphenol, nonylphenol, decylphenol, 7-octenylphenol, hydroxybenzyl alcohol, hydroxybenzaldehyde, hydroxybenzoic acid, naphthol, and hydroxynaphthoic acid. All of the foregoing patents and literature references relating to preparation of O-glycosides are incorporated herein by reference.

The structure of one of a number of possible isomers of the O-glycoside resulting from the reaction of dodecyl alcohol and glucose (i.e., dodecyl glucoside) can be represented as follows:

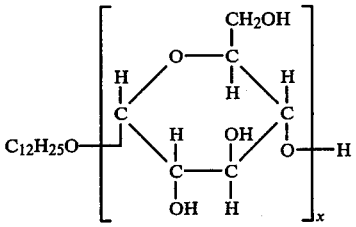

wherein x is the number of repeating glucosyl units.

The product of the reaction between aliphatic or aromatic alcohol(s) or alkoxylated alcohol(s) and saccharide(s) to produce O-glycoside surfactant is a complex mixture of O-glycosides differing in isomeric configuration and in number of glycosyl units, and containing polysaccharides (i.e., polymerized saccharide which has not been etherified with alcohol), unreacted monosaccharide(s) or unhydrolyzed sources of monosaccharide(s), unreacted alcohol(s), neutralized catalyst, possibly polyalkylated glycosides, and other unknown reaction by-products. If the O-glycosides are made by the latent solvent method described in U.S. Pats. Nos. 3,772,269 and 3,598,865, the reaction product will also contain O-glycosides of the lower alkanols or glycols used as the latent solvent. It is generally quite satisfactory to use the unpurified reaction product as the source of O-glycoside surfactants in the coal slurries of the present invention. Since extra costs are incurred in purification, it may be preferable to use the unpurified reaction product. Usually, unreacted alcohol is the major contaminant in the O-glycoside reaction product, and it is the easiest to remove (e.g., by distillation). The cost of the aliphatic or aromatic alcohol feedstock will generally be the prime factor in determining if it should be substantially removed and recycled.

Although the reason for the excellent results exhibited by the O-glycosides used in the present invention cannot yet be fully explained, the following is offered by way of theory. The invention, of course, is not to be limited in any way by this proposed theoretical explanation.

O-Glycosides have a molecular configuration that has a distinctively hydrophobic end or tail and a distinctively hydrophilic end or head. However, these materials differ from other classes of surfactants in that the hydrophilic head portion of the molecule is large and bulky with a high concentration of hydroxyl groups which have a very affinity for water. The degree of molecular bulkiness or hydrophilicity can be varied, of course, by controlling the number of glycosyl units (x) in each O-glycoside molecule. Similarly the bulk and hydrophobicity of the O-glycoside can be controlled by selection of the aglycone group.

Coal is a highly variable substance with an exceedingly complex chemical structure, which has not yet been fully and conclusively defined. The relative hydrophobicity of the surface of a coal particle varies according to its innate chemical composition and can be altered by oxidation due to air exposure. Relative to petroleum, coal may be more hydrophilic; relative to water it is clearly hydrophobic and not readily wetted by water. This is particularly true for freshly ground coal which has surfaces which have not been altered by air oxidation. In the absence of surfactants, coal particles do not easily disperse in water and tend to form agglomerates or clumps of particles.

In water solutions, the surface-active O-glycosides are readily attracted to the interface between coal particles and water with the hydrophobic end of the glycoside adsorbed on the nonpolar surfaces of the coal. The bulky hydrophilic end of the O-glycoside is oriented away from the coal surface into the bulk of the continuous water phase. The bulky glycoside heads hydrate and are associated with water molecules and form an effective barrier around each particle. This barrier acts to efficiently wet the particles and inhibit contact between and agglomeration of the particles, thus acting as an effective wetting and dispersing additive.

If the O-glycosides are used at levels above their critical micelle concentrations in the continuous aqueous phase of the CWS, an ordered mesomorphic phase structure is formed. Formation of this ordered structure is aided by the presence of some colloidal-sized coal particles. When undisturbed, this ordered structure forms a semi-rigid lattice network which serves to suspend the coal particles and inhibit their settling. A characteristic or these phases is that upon disturbance (e.g., by stirring or pumping), the ordered structure breaks down, and the resulting suspension behaves as a non-Newtonian liquid with pseudoplastic and thixotropic flow properties. This means as the shear rate is increased, the apparent viscosity decreases. Also, with a constant shear rate, viscosity decreases with time. Rheologically, the minimum amount of shear disturbance (i.e., shearing stress) which initiates structure breakdown and fluid flow is known as the yield value. The ordered mesomorphic phase can re-establish itself when the shear disturbance is removed.

The amount of O-glycoside needed to disperse and suspend the coal particles is dependent upon the amount of coal surface available—i.e., the amount and particle size distribution of the coal in the slurry. In general, the smaller the coal particles, the greater is the surface area per unit weight of coal and the greater is the amount of a given O-glycoside required.

Many variables are known to influence the viscosity and stability of a coal-water slurry; e.g., coal particle size/shape distribution, coal source/treatment, coal concentration, pH, types and concentrations of additives, method of preparation, and conditions of storage and handling. When coal-water slurries are produced using the O-glycosides of the present invention, selection of the composition, concentration, and purity of the preferred O-glycosides must take the preceding variables into account.

Because of the large differences in properties of coals from different sources and the differences in properties of O-glycosides made from different alcohol and saccharide reactants, no rules have been found which can be applied universally to formulation of coal slurries within the scope of the present invention. Trial and error experimentation is sometimes necessary to achieve slurries having the particular properties sought by the formulator. Nevertheless, the following guidelines have been found useful in formulating CWS's using O-glycoside surfactants:

1. The preferred R of the aglycone of an O-glycoside seems to vary with the particle size distribution of the coal used. Relatively short R's (e.g., of 8 to 10 carbon atoms) are preferable for use with very fine coal particles (i.e., about 85 wt.% to 90 wt.% through 325 mesh); relatively long R's (e.g., of about 18 carbon atoms) are preferable for use with coarser coal particles (i.e., about 50 wt.% through 325 mesh).

2. With fine coals and O-glycosides having short R's, a longer glycosyl chain (i.e., higher x) seems to be desirable for slurry stability whereas shorter glycosyl chains (i.e., lower x) provide thinning action. The converse is true when dealing with coarser coals and O-glycosides having long R's.

3. The physiochemical characteristics of coal particle surfaces vary depending on the source of the coal and its treatment. Preferred O-glycosides can be identified by screening O-glycosides which differ in their balance of hydrophilic and lipophilic character, which is primarily a function of R, R', t, and x in the O-glycoside generic formula $RO(R'O)_t—(Z)_x—H$. In this screening process, the optimal level of the preferred O-glycosides can be determined. Both under- and over-usage of the O-glycosides can result in less than preferred physical characteristics for the slurry.

4. CWS's having high concentrations of coal tend to be more stable than more dilute CWS's. Hence, it is necessary to select a coal concentration which gives an appropriate balance of stability and viscosity for the contemplated conditions of handling, storage, and use.

5. pH can be a factor in obtaining a physically stable aqueous suspension of coal particles with desirable viscosity and rheology. The typical "unadjusted" pH of slurries formed in accordance with this invention is from about 4 to about 9, depending on the chemistry of the incorporated coal. The literature has discussed the adjustment of pH to about 8 as an aid to obtaining good CWS properties. Therefore, if a particular O-glycoside-containing coal slurry is not satisfactory, variations should be prepared wherein the pH is adjusted upwards or downwards with base or acid to establish the pH which produces the best results.

6. Co-additives can importantly influence the properties of the CWS:

a. Anionic surfactants are known to be effective in reducing coal slurry viscosities, and they can be added to slurries of the present invention if it is desired to reduce their viscosities. Typical anionic surfactants are the $C_8$ to $C_{18}$ alkyl sulfates, alkyl sulfonates, alkyl ether sulfates, alkyl benzene sulfonates, condensed naphthalene sulfonates, and lignosulfonates. Care must be taken to not use excessive amounts of anionic co-surfactants since such an over-use could result in a loss of slurry stability and "hard-packing" of the coal. Generally, if needed at all, the amount of anionic co-surfactant used will be from about 0.01% to about 3.0% of the slurry composition.

b. Bases, such as $NH_4OH$, in an amount of from about 0.01% to about 3% of the CWS are sometimes useful in increasing the "ionic character" of the CWS system, usually providing a thinning effect. As with anionic surfactants, too much ionic character must be avoided to prevent a loss of CWS stability.

c. Suspending agents such as clays, starches and gums, which are typically used in coal-water slurries are generally not necessary in the compositions of the present invention. They can, nevertheless, be included in said compositions, if desired, at levels up to about 1.0% of the composition.

d. In some cases, it is believed that thicker, more stable coal-water slurries may be prepared by either leaving larger amounts of unreacted alcohol(s) in the finished O-glycoside product, or by adding aliphatic or aromatic alcohol(s) to the O-glycoside product or to the CWS.

e. To prevent possible microbiological growth in the CWS, up to about 0.05% of an antimicrobial agent (e.g., formaldehyde) may be added.

f. If excessive foaming occurs during the preparation or handling of the CWS, up to about 0.5% of a defoaming agent may be added to the slurry. Typical defoaming agents which can be used are the silicones. Also, substantial levels of free fatty alcohols in the O-glycoside product or added to the slurry can reduce foaming.

The O-glycoside surfactants of the present invention are added to an aqueous slurry of coal in an amount of 0.01% to 5% by weight, preferably 0.3% to 2.5% by weight, based on the total amount of the aqueous slurry. Ordinarily, when a surfactant is not added to an aqueous slurry of coal powder, the viscosity abruptly increases if the concentration of coal exceeds about 40–45% by weight based on the total amount of the slurry, although this critical value varies to some extent depending on the kind and particle size of coal powder. If the coal concentration is too low in the aqueous coal slurry, the transportation efficiency is lowered and the slurry must undergo an expensive dehydration step before combustion, thus detracting from the favorable economics of CWS use. If the coal concentration is too high, the viscosity correspondingly becomes too high. Accordingly, the coal concentration is adjusted to 50% to 80% by weight, preferably 60% to 75% by weight, although the specified coal concentration may be varied to some extent depending on the type of coal, the desired viscosity, the desired stability characteristics, and whether or not one may choose to add an ionic co-additive, as discussed supra.

The invention will be illustrated by the following examples which demonstrate the superiority of the O-glycoside surfactants of the present invention over surfactants suggested by the prior art for coal slurry use. The examples are not in any way to be construed as limitative of the scope of the present invention.

EXAMPLE 1

Preparation of $C_{12}/C_{14}$ O-Glucoside

An O-glucoside surfactant wherein the aglycone is a $C_{12}/C_{14}$ alkyl (referred to hereinafter as AG-1214) was prepared using the following reagents:

TABLE I

| Reagent | Source |
|---|---|
| Anhydrous Glucose (Cerelose) | CPC International |
| $C_{12}/C_{14}$ Fatty Alcohol (pure chains mixed) | Ethyl Corp. |
| p-Toluenesulfonic Acid-Monohydrate (TX0770) | MCB Reagents |
| n-Butanol (BX1780) | MCB Reagents |

To a 30-gallon glass-lined reactor were added 82.3 pounds (37.3 kg) n-butanol, 20.0 pounds (9.1 kg) anhydrous glucose, 68.9 pounds (31.2 kg) fatty alcohol (70/30 mixture of $C_{12}/C_{14}$ fatty alcohols), and 175 grams p-toluenesulfonic acid monohydrate. This reaction mixture was heated to reflux temperature, then stirred at reflux (120° C.) for 30 minutes, at which time another 10 pounds (4.54 kg) anhydrous glucose and 87.5 grams p-toluenesulfonic acid monohydrate were added. After refluxing with stirring for another 10 minutes, the final 10 pounds (4.54 kg) anhydrous glucose and 87.5 grams p-toluenesulfonic acid monohydrate were added, and the mixture was refluxed at 120° C. for 20 minutes. Heating was discontinued, and the mixture was stirred for 70 minutes without heating. Heating was then resumed, and vacuum distillation was begun.

Full vacuum of 100 mm Hg was reached after 1 hour. The distillation was continued under full vacuum for 2.5 hours with the reactor temperature held between 96° and 99° C. Heating was discontinued, and the mixture was neutralized by the addition of 95 grams sodium carbonate in 500 ml water. The weight of this crude product was 102 pounds (46.2 kg).

Twenty-six pounds (11.8 kg) of the crude product, containing 1% added $C_{16}$ alcohol, was stripped of fatty alcohol using a Luwa Evaporator such that the final fatty alcohol content by GC area percent was 0.8%. This is referred to as Product A.

Twenty-two and one-half pounds (10.2 kg) of the crude product, containing 3% added $C_{16}$ alcohol, was stripped of fatty alcohol using a Luwa Evaporator such that the final fatty alcohol content by GC area percent was 0.7%. This is referred to as Product B.

Twelve pounds (5.4 g) of Product A and six pounds (2.7 kg) of Product B were combined to give 18 pounds (8.1 kg) of product which was decolorized by bleaching with Darco-G-60 charcoal in order to permit its evaluation in other applications requiring light-colored surfactant. Use in coal-water slurries, obviously, does not require such treatment. The resulting bleached product was the AG-1214 surfactant used in test work reported infra.

Using gas chromatography, this AG-1214 surfactant was analyzed to contain at least 62.5% O-glucosides with $x \leqq 5$ (34.7% $RG_1$, 13.5% $RG_2$, 7.5% $RG_3$, 4.2% $RG_4$, and 2.6% $RG_5$), higher $RG_x$'s not capable of analysis by GC, 1.0% fatty alcohol, 9.5% polysaccharides, and 1.6% volatiles. In the term $RG_x$, as used above, R signifies $C_{12}/C_{14}$ alkyl, G signifies the glucosyl moiety, and x signifies the number of repeating glucosyl units in a chain.

EXAMPLE II

Preparation of $C_{18}$ O-Glucosides

O-glucoside surfactants wherein the aglycone is a $C_{18}$ alkyl were prepared using the following reagents:

TABLE II

| Reagent | Source |
|---|---|
| Anhydrous D-Glucose Powder (Dextrose D-16) | Fisher Scientific |
| $C_{18}$ Fatty Alcohol (CO-1895) | Proctor & Gamble |
| n-Butanol (BX1780) | MCB Reagents |
| Linear Alkyl Benzene Sulfonic Acid (HLAS) | Procter & Gamble |

Into a 5-liter, 3-necked round-bottom flask (equipped with a mechanical stirrer, a thermometer, and a vacuum distillation column with a receiving flask) were added 250 grams (1.39 moles) anhydrous glucose, 1200 grams (4.44 moles) $C_{18}$ fatty alcohol, 1012.5 grams (13.66 moles) n-butanol, and 16.0 grams (0.051 mole) HLAS. This reaction mixture was heated with stirring to reflux temperature (115° C.). The reaction mixture, initially a slurry, clarified to a clear yellow solution in about 30 minutes. Some distillate was collected atmospherically. Another 125 grams (0.69 mole) anhydrous glucose was added to the refluxing solution, which clarified again in about 30 minutes. The last 125 gram (0.69 mole) portion of anhydrous glucose was then added to the refluxing solution. The resultant brownish-yellow cloudy slurry never totally clarified, although all solid materials did go into solution. Some amount of water-butanol azeotrope was collected atmospherically. The reaction mixture was allowed to reflux for about 30–45 minutes after the last addition of anhydrous glucose.

Reduced pressure distillation to remove the water-butanol azeotrope was then performed. Initially, the water-butanol azeotrope was removed at a rate which allowed the temperature of the reaction mixture temperature to be maintained between 100° and 110° C. As the pressure was dropped toward full water aspirator vacuum, the reaction mixture temperature decreased. At full vacuum (25 mm Hg), the reaction mixture temperature was maintained between 95° and 98° C., and the vapor temperature remained at about 40°–45° C. The reaction mixture had assumed a dark brown color and appeared to be quite viscous. When the vapor temperature fell to 38° C. and the reaction mixture was at 97° C., the reaction was terminated by neutralization with 2.5 grams NaOH in 5 ml water. The distillation had taken a total of 225 minutes. The reaction mixture was allowed to cool to room temperature, at which point it was a beige solid (Product C).

A portion of this crude reaction mix (Product C) was worked up as follows. About 450 grams of Product C was melted, added to a 4-liter flask, and diluted with 3000 ml acetone. The resultant slurry was brought to reflux temperature (56° C.), cooled to room temperature, and vacuum filtered. The filter cake was slurried in 2000 ml acetone at room temperature and filtered. The resulting filter cake was once more slurried with 2000 ml acetone at room temperature and filtered, producing a filter cake that weighed 166 grams after air drying. The dried filter cake was then slurried into 2000 ml methanol at room temperature. The methanol-insoluble materials were separated from the liquor, and the liquor was evaporated to dryness. The residue, a yellow, soft solid material was then recrystallized from 1000 ml acetone at room temperature and air dried to obtain 109 grams of crystals (Product D) containing 11.7% unreacted fatty alcohol. This product is referred to as AG-18 in the test work reported infra.

The work-up of another portion of the reaction mix (Product C) was performed as follows. 300 grams of Product C was diluted with 2000 ml methyl ethyl ketone (MEK), heated to reflux, cooled to room temperature with stirring, and vacuum filtered. The filter cake was then twice reslurried into 1200 ml MEK and vacuum filtered. After air drying, the final filter cake weighed 105 grams (Product E) and contained 0.5% unreacted fatty alcohol.

Another 300 grams of Product C was diluted with 2000 ml MEK, heated to reflux, cooled to room temperature with stirring, and vacuum filtered. The filter cake was slurried into 1200 ml MEK and vacuum filtered. Next, the filter cake was slurried into 1000 ml of 25% methanol in MEK. The insolubles were separated from the liquor, and the liquor was evaporated to dryness. The residue resulting from the evaporation of the liquor was a soft yellow solid weighing 96.6 grams and containing 32.5% unreacted fatty alcohol. This is referred to as Product F.

One part of Product E and 3 parts of Product F were blended together and the resulting blend is referred to as AG-18A in the test work reported infra.

EXAMPLE III

Preparation of $C_8$–$C_{18}$ O-Glycoside

An O-glucoside surfactant wherein the aglycone is a broad cut $C_8$–$C_{18}$ alkyl chain was prepared using the following reagents:

TABLE III

| Reagent | Source |
|---|---|
| Anhydrous D-Glucose Powder (Dextrose D-16) | Fisher Scientific |
| Whole-Cut Coconut Alcohol (CO-618A) | Proctor & Gamble |
| n-Butanol (BX1780) | MCB Reagents |
| Linear Alkyl Benzene Sulfonic Acid (HLAS) | Procter & Gamble |

To a 3-neck, 5-liter round bottom flask (equipped with a heating mantle, Thermowatch temperature controller, Teflon-blade mechanical stirrer, and cold water condenser, set up for reflux) were added 1090.0 grams (14.7 moles) butyl alcohol, 946.0 grams (4.8 moles) whole-cut coconut alcohol, 5.4 grams (0.017 mole) linear alkyl benzene sulfonic acid, and 270.0 grams (1.5 moles) anhydrous D-glucose powder. This reaction mixture was heated while stirring to reflux temperature (about 117° C.). When the mixture clarified to a pale yellow liquid after about 45 minutes, another 135 grams (0.75 mole) glucose was added, and a Dean and Stark trap (to collect water) was inserted between the condenser and round bottom flask. The reaction mixture was refluxed until it again clarified. The final 135 grams (0.75 mole) glucose was added to the reaction mixture which was stirred and refluxed for two hours, filling the Dean and Stark trap with about 20 ml water. The reaction mixture was primarily a clear pale yellow liquid at this point.

The synthesis apparatus was then modified. The Dean and Stark trap was removed. The condenser was placed in a distilling position with a connecting thermometer adapter (to monitor the vapor temperature of the distillate). A vacuum adapter, connected to a water aspirator, was positioned between the condenser and the receiving flask. During this changeover, the reaction mixture cooled to about 90° C., and a white gelatinous substance formed. Upon heating to 110° C. and stirring for 30 minutes, a small amount of this substance did not completely redissolve, and was removed from the reaction flask before distillation.

The distillation to remove butanol and water was carried out between 95° and 110° C., gradually increasing the vacuum (with a water aspirator) over about a 3 hour period. At that point, the vapor temperature was 100° C., and the reaction mixture was a tan, slightly viscous liquid. After adding 3 more grams of HLAS, the full aspirator vacuum was applied for 1 hour. The reaction mixture was then allowed to stand overnight without vacuum or heat.

The distillation was continued the next day at a temperature between 107° and 110° C. The mixture was stirred and subjected to full aspirator vacuum for 1 hour, at which point the vapor temperature dropped to 85° C., and the mixture was a tan viscous liquid. A vacuum pump was then connected to the synthesis apparatus in place of the water aspirator. Over a period of about 1.5 hours, the pressure was lowered from 25 mm Hg to full vacuum at a gradual rate so as to avoid excessive foaming. Finally, the vapor temperature fell to 35° C. and the temperature of the reaction mixture was lowered to 100° C. The reaction mixture was neutralized to pH 7 with 1.08 grams NaOH in about 5 ml water. The mixture was now a viscous yellow-brown liquid. As it cooled, it became a soft yellow-brown solid.

The reaction mixture was then worked up as follows. About 800 grams of the above reaction mixture and 1500 ml acetone were placed in a 2-liter flask and stirred at 50° C. for 1.5 hours. An off-white crystalline precipitate formed. After cooling to room temperature, the reaction mix/acetone mixture was filtered in a Buchner funnel using a water aspirator.

The filtered precipitate and 1 liter of acetone were then placed in a 2-liter flask and stirred for 2 hours at 50° C. Once again, the precipitate was filtered in a Buchner funnel using a water aspirator. The filtered precipitate was dried in a vacuum oven (connected to a water aspirator) for 2 hours at 75° C., then ground with a mortar and pestle. The resulting product contained 3.3% unreacted fatty alcohol. This product is referred to as AG-818 in the test work described infra.

EXAMPLE IV

In this example, O-glucoside surfactants prepared according to the previous examples were formulated into coal-water slurries and the properties of those slurries were compared with those of slurries prepared with the following commercially available surfactants: Lomar D (sodium salt of a condensed naphthalene sulfonic acid) from Diamond Shamrock Corporation; and Neodol 25-3A ($C_{12}$–$C_{15}$ linear primary alcohol ethoxysulfate ammonium salt) from Shell Chemical Company.

Eastern Bituminous coal, having the following characteristics, was used in the present work:

TABLE IV

| | |
|---|---|
| Moisture | 1.42 Wt. % |
| Ash | 6.30 Wt. % |
| Sulfur | 0.72 Wt. % |
| Volatiles | 35.75 Wt. % |
| Fixed Carbon | 56.53 Wt. % |
| BTU | 13395/lb. |

This coal was pulverized to a size such that 63.3 wt.% passed through a 200 mesh sieve and 47.8 wt.% passed through a 325 mesh sieve. While this particular pulverized coal was used for illustrative purposes, it should not be construed that the invention is restricted thereto.

Coal-water slurries were prepared for evaluation in the following manner. The amount of surfactant needed to attain the desired usage concentration in a 350 gram batch of slurry was weighed into a mixing bowl. The desired weight of water (distilled) was then added to the surfactant. If heating was required to dissolve the surfactant in the water, the surfactant/water solution was reweighed after the surfactant had dissolved and lost water was added back to the desired weight. Pulverized coal (described above) of a weight such that the finished slurry would contain 65 wt.% coal was added to the surfactant/water solution. The slurry components were then mixed using a Hobart Kitchen Aid Model K45SS Heavy Duty Food Preparer on its lowest speed setting for 55 minutes. If the slurry foamed during mixing, a defoamer (General Electric AF-72 silicone emulsion—30% active) was added as needed. The slurry was then reweighed, water lost through evaporation was added back, and the slurry was mixed for an additional 5 minutes to conclude the slurry-making procedure. In the water added back, 0.5 gram 36% formaldehyde was included to avoid possible microbial growth in the slurry. Table V summarizes the compositions of the various coal-water slurries which were prepared.

The viscosity of each CWS was measured immediately after transferring the finished slurry from the mixing bowl to a 1-pint glass jar. A Brookfield synchro-lectric viscometer Model RVT with a #3 spindle was used to read the viscosity at 5, 10, 20, and 50 rpm (or to as high an rpm as was possible using the #3 spindle). These readings, taken at each successive speed after running for 4 minutes at that speed, constituted the "Initial Viscosity" measurements.

After storing a coal slurry undisturbed in a 1-pint jar for 13 days at 70° F. (21° C.), its "Final Viscosity" was determined in the same manner as was its "Initial Viscosity" (described above). If a substantial amount of coal settled to the bottom of the container during storage, thereby forming a "hard pack," no Final Viscosity measurement could be taken.

Immediately after making a CWS, a portion of the slurry was placed into a "stability tube," a plastic PVC pipe about 7 inches long with a ¾ inch inner diameter and a rubber stopper to seal each end. A stability tube actually holds about 6 inches of CWS, and is filled to just below the level of the top stopper. The stability test consisted of storing these tubes vertically at 70° F. (21° C.) for 13 days undisturbed. At the end of that time, the tubes were frozen in a −20° C. refrigerator and the solid "cores" of CWS were forced out. These "cores" were quickly cut into six approximately one inch long fractions. The fractions were then weighed, dried in a 105° C. oven for 75 minutes (to constant weight), and reweighed. The wet and dry weight data were then converted into a weight percent solids for each of the six fractions of a stability tube and graphed. The area between the ideal stability curve (a flat straight line at the average weight percent coal in the slurry) and the experimentally determined stability curve was calculated (units are expressed as fractionweight percent solids or "F-WPS") and used as a measure of sample stability ("Area Deviation").

Slurries with good stability have small (about 0–10 F-WPS) Area Deviations; those with poor stability have large (greater than about 25 F-WPS) Area Deviations.

The results obtained in this example are summarized in Table VI. It may be observed that the anionic additives (Lomar D and Neodol 25-3A) generally produce coal-water slurries with lower initial viscosities than do the O-glucosides, agreeing with the literature which usually cites anionics as the preferred dispersants of coal for CWS. However, the use of anionic additives in the present study always resulted in "hard packing" of the coal, thereby demonstrating that anionics produce very poor CWS stability. In contrast, most of the samples containing O-glycosides were stable, and, depending on the alkyl glycoside type and concentration, could have viscosities in the same range as samples containing anionic additives. The thicker coal-water slurries produced by the addition of some glycoside surfactants should pose no problem with regard to pumpability since pumps exist (for example, Moyno progressive cavity pumps) which can handle fluids having viscosities as high as 700,000 cp. Such a viscosity is much higher than any which would be encountered as a result of O-glycoside surfactant usage in CWS.

A statistical analysis of the test data generated by the present study indicated that the effect of the additive is statistically significant at the 8% risk level, or the 92% confidence level. When the Student Newman-Keuls Multiple Comparison yardstick was applied to the means of the Area Deviations (stabilities) for each additive, it showed that the Neodol 25-3A (mean 48,097) and Lomar D (mean 42.05) slurries had significantly greater Area Deviations (less stability) than the three alkyl glycoside surfactants: AG-18 (mean 1.033), AG-1214 (mean 2.47), and AG-818 (mean 18.70). The Student Newman-Keuls Test holds the total experimentwise error rate at or under 0.05 under the complete null hypothesis, i.e., that the population mean for each of the additives is zero. The differences between the means for the Neodol 25-3A and the Lomar D slurry stabilities are not statistically significant, nor are the differences between the means for the AG-containing slurries.

TABLE V

Coal-Water Slurry Formulations

| Additive | Weight Additive (grams) | Weight Coal (As Received) (grams) | Weight Distilled Water (grams) | Weight Defoamer (grams) |
|---|---|---|---|---|
| Lomar D | 1.75 | 227.50 | 120.75 | 0 |
| Lomar D | 3.50 | 227.50 | 119.00 | 0 |
| Lomar D | 7.00 | 227.50 | 115.50 | 0 |
| Neo. 25-3A | 3.10* | 227.50 | 118.66 | 0.74 |
| Neo. 25-3A | 6.10* | 227.50 | 115.29 | 1.11 |
| Neo. 25-3A | 12.30* | 227.50 | 109.09 | 1.11 |
| AG-1214 | 1.75 | 227.50 | 120.38** | 0.37 |
| AG-1214 | 3.50 | 227.50 | 118.63** | 0.37 |
| AG-1214 | 7.00 | 227.50 | 115.01** | 0.49 |
| AG-18 | 1.75 | 227.50 | 120.55** | 0.20 |
| AG-18 | 3.50 | 227.50 | 118.88** | 0.12 |
| AG-18 | 7.00 | 227.50 | 115.38** | 0.12 |
| AG-818 | 1.75 | 227.50 | 120.38** | 0.37 |
| AG-818 | 3.50 | 227.50 | 118.63** | 0.37 |
| AG-818 | 7.00 | 227.50 | 115.01** | 0.49 |

*Neodol 25-3A is 57% Active.
**Weight includes 0.5 gram 36% formaldehyde.

TABLE VI

Test Results on Formulations in Table V

| Additive | Weight Percent Additive in CWS | Calculated Wt. % Dry Coal in CWS | Area Deviation (F-WPS) | Viscosity (cp) (20 rpm, #3 Brookfield) Initial | Final |
|---|---|---|---|---|---|
| Lomar D | 0.5 | 64.00 | 55.32 | 850 | HP |

TABLE VI-continued

Test Results on Formulations in Table V

| Additive | Weight Percent Additive in CWS | Calculated Wt. % Dry Coal in CWS | Area Deviation (F-WPS) | Viscosity (cp) (20 rpm, #3 Brookfield) Initial | Final |
|---|---|---|---|---|---|
| Lomar D | 1.0 | 65.00 | 42.87 | 1112 | HP |
| Lomar D | 2.0 | 66.24 | 26.32 | 1875 | HP |
| Neo. 25-3A | 0.5 | 64.57 | 52.90 | 1110 | HP |
| Neo. 25-3A | 1.0 | 64.85 | 51.70 | 1325 | HP |
| Neo. 25-3A | 2.0 | 66.32 | 39.69 | 3115 | HP |
| AG-1214 | 0.5 | 67.67 | 1.47 | 2975 | 3340 |
| AG-1214 | 1.0 | 66.61 | 1.32 | 3280 | >5000 |
| AG-1214 | 2.0 | 67.00 | 4.62 | 4100 | 1685 |
| AG-18 | 0.5 | 68.72 | 0.88 | 2075 | 2680 |
| AG-18 | 1.0 | 65.82 | 1.68 | (off-scale) | |
| AG-18 | 2.0 | 66.52 | 0.54 | (off-scale) | |
| AG-818 | 0.5 | 67.48 | 1.62 | 1825 | 1905 |
| AG-818 | 1.0 | 65.35 | 19.39 | 1532 | 1725-HP |
| AG-818 | 2.0 | 65.62 | 33.70 | 1250 | HP |

Notes:
(1) 1.0% Lomar D and 1.0% AG-818 results are averages of 3 samples, hence the 1725-HP designation for the Final Viscosity of AG-818.
(2) "HP" means that the coal in a sample is "hard packed."

EXAMPLE V

This example demonstrates that glycoside surfactants may be used in conjunction with co-surfactants to tailor the properties of CWS systems. Table VII summarizes the compositions of the pertinent coal-water slurries, prepared as in Example IV.

TABLE VII

Coal-Water Slurry Formulations

| Additive | Weight Additive (grams) | Weight Coal (As Received) (grams) | Weight Distilled Water (grams) | Weight Defoamer (grams) |
|---|---|---|---|---|
| AG-18 | 3.50 | 227.50 | 118.88* | 0.12 |
| AG-18 | 7.00 | 227.50 | 115.38* | 0.12 |
| AG-18 | 3.07 | 252.50 | 118.80* | 0.20 |
| Lomar D | 0.44 | | | |
| AG-18 | 2.62 | 227.50 | 118.88* | 0.12 |
| Lomar D | 0.88 | | | |

*Weight includes 0.5 gram 36% formaldehyde.

It may be observed in Table VIII that two of the viscosity readings for AG-18-containing coal slurries (1.0 and 2.0 wt.%) were too high to be measured using a Brookfield viscometer with a #3 spindle. However, the addition of an anionic co-surfactant (Lomar D) resulted in a CWS with a much lower viscosity and good stability (e.g., 0.82 wt.% AG-18, 0.12 wt.% Lomar D), even at a higher coal loading (67.3 wt.% target with as-received coal) than was employed in most of the present work (65.0 wt.% coal target). The addition of too much anionic co-surfactant resulted in a loss of CWS stability (e.g., 0.75 wt.% AG-18, 0.25 wt.% Lomar D).

TABLE VIII

Test Results on Formulations in Table VII

| Additive | Weight Percent Additive in CWS | Calculated Wt. % Dry Coal in CWS | Area Deviation (F-WPS) | Viscosity (cp) (20 rpm, #3 Brookfield) Initial | Final |
|---|---|---|---|---|---|
| AG-18 | 1.0 | 65.82 | 1.68 | (off-scale) | |
| AG-18 | 2.0 | 66.52 | 0.54 | (off-scale) | |

TABLE VIII-continued

| Test Results on Formulations in Table VII | | | | | |
|---|---|---|---|---|---|
| Additive | Weight Percent Additive in CWS | Calculated Wt. % Dry Coal in CWS | Area Deviation (F-WPS) | Viscosity (cp) (20 rpm, #3 Brookfield) Initial | Final |
| AG-18 | 0.82 | 68.45 | 5.96 | 1650 | 3325 |
| Lomar D | 0.12 | | | | |
| AG-18 | 0.75 | 65.30 | 25.73 | 1075 | 4105 |
| Lomar D | 0.25 | | | | |

EXAMPLE VI

This Example demonstrates the use of an O-glycoside surfactant without other additives to produce a stable, pumpable coal-water slurry. The coal, method of CWS preparation and test methods employed in this Example are the same as in Examples IV and V, except that (1) no defoamer was used in this Example, and (2) the Stability and Final Viscosity measurements were made on coal slurries after 6 days of storage at 70° F. (21° C.) rather than 13 days as in Examples IV and V.

The composition of this particular CWS was: 227.50 grams Eastern Bituminous coal, 146.25 grams distilled water, and 1.75 grams AG-18A (preparation described in Example II). Table IX summarizes the stability and viscosity data for this AG-18A CWS. It should be noted that, rather than settle, the coal particles in this slurry actually migrated toward the top of the stability tube (top one-sixth=65.5% solids, bottom one-sixth=62.9% solids).

TABLE IX

| Test Results | | | | | |
|---|---|---|---|---|---|
| Additive | Weight Percent Additive in CWS | Calculated Wt. % Dry Coal in CWS | Area Deviation (F-WPS) | Viscosity (cp) (20 rpm, #3 Brookfield) Initial | Final |
| AG-18A | 0.47 | 63.83 | 2.37 | 1790 | 715 |

EXAMPLE VII

A commercially available O-glycoside, Triton BG-10 (a biodegradable glucoside made from $C_8$ and $C_{10}$ fatty alcohols by Rohm and Haas Company), was tested in coal-water slurries. Table X summarizes the compositions of the pertinent coal-water slurries:

TABLE X

| Coal-Water Slurry Formulations | | | | |
|---|---|---|---|---|
| Additive | Weight Additive (grams) | Weight Coal (As Received) (grams) | Weight Distilled Water (grams) | Weight Defoamer (grams) |
| BG-10 | 3.50 | 227.50* | 169.00 | 0.25 |
| BG-10 | 3.50 | 227.50** | 148.00 | 0.25 |

*Eastern Kentucky Bituminous:
96.5% through 200 mesh
88.1% through 325 mesh
**50/50 Blend of Eastern Kentcuky Bituminous:
96.5% through 200 mesh
88.1% through 325 mesh
Eastern Bituminous:
63.3% through 200 mesh
47.8% through 325 mesh The method of CWS preparation and the test methods employed in this example are the same as in Examples IV and V, except that the Stability measurement was made on coal slurries after 10 days of storage at 70° F. (21° C.) rather than after 13 days as in Examples IV and V.

TABLE XI

| Test Results on Formulations in Table X | | | | | |
|---|---|---|---|---|---|
| Additive | Weight Percent Additive in CWS | Calculated Wt. % Dry Coal in CWS | Area Deviation (F-WPS) | Viscosity (cp) (10 rpm, #3 Brookfield) Initial | Final |
| BG-10 | 0.87* | 58.92 | 2.84 | 9330 | *** |
| BG-10 | 0.92** | 60.84 | 4.40 | 7320 | *** |

*Eastern Kentucky Bituminous (see Table X).
**50/50 Blend of Eastern Kentucky and Eastern Bituminous (see Table X).
***Rotation of spindle in soft packed coal slurry "grooved out" a path, resulting in a very low viscosity reading.

What is claimed is:

1. Coal-water slurry compositions comprising:

(a) from about 50% to about 80% of finely divided coal particles having a particle size such that substantially none of said particles has a size greater than 4 Tyler mesh;

(b) from about 0.01% to about 5.0% of O-glycoside surfactants; and (c) from about 15% to about 50% water.

2. The composition of claim 1 wherein at least 40% of the coal particles are smaller than 200 mesh.

3. The composition of claim 2 wherein the O-glycoside has the formula $$RO(R'O)_t—(Z)_x—H$$

wherein R is selected from the group consisting of substituted and unsubstituted aliphatic and aromatic hydrocarbons having from 6 to about 32 carbon atoms, wherein the substituents are nonionic groups consisting of carbon, hydrogen, oxygen or combinations thereof, R' is selected from substituted and unsubstituted alkyl and alkenyl groups having from 2 to 4 carbon atoms, wherein the substituent is hydroxy, t is a single number or distribution of numbers from 0 to about 30, Z is the residue of a reducing monosaccharide, and x is a single number or distribution of numbers from 1 to about 50.

4. The composition of claim 3 wherein Component (b) is added as a 10% to 100% active O-glycoside product, the remainder of said O-glycoside product comprising unreacted aliphatic or aromatic alcohol(s), unreacted saccharide(s) or sources of saccharides(s), polysaccharides, other reaction by-products, or other additives.

5. The composition of claim 4 wherein the ionic character of the slurry is increased by the addition of from about 0.01% to about 3% of a compound selected from the group consisting of bases, anionic surfactants and mixtures thereof.

6. The composition of claim 4 wherein the composition contains up to about 1.0% of a suspending agent.

7. The composition of claim 4 wherein the composition contains up to about 0.5% of an antimicrobial agent.

8. The composition of claim 4 wherein the composition contains up to about 0.5% of a defoaming agent.

9. The composition of claim 4, 5, 6, 7, or 8 wherein R in the O-glycoside is $C_8$–$C_{18}$ alkyl or alkenyl, t equals 0, Z is a glucosyl moiety, and x is from 1 to about 25.

10. The composition of claim 9 wherein the amount of Component (b) is from about 0.3% to about 2.5% of said composition.

11. The composition of claim 10 wherein the amount of Component (a) in said composition is from about 60% to about 75%.

* * * * *